United States Patent [19]

Beilush

[11] Patent Number: 4,957,223

[45] Date of Patent: Sep. 18, 1990

[54] DISPENSER GUN

[76] Inventor: Moishe Beilush, 1431 - 52nd St., Brooklyn, N.Y. 11219

[21] Appl. No.: 393,252

[22] Filed: Aug. 14, 1989

[51] Int. Cl.[5] ..... B65D 88/54

[52] U.S. Cl. ..... 222/340; 222/326; 222/392

[58] Field of Search ..... 222/309, 325, 326, 327, 222/391, 392, 336, 336, 340, 105, 386, 92, 95

[56] References Cited

U.S. PATENT DOCUMENTS

| | | | |
|---|---|---|---|
| 3,058,632 | 10/1962 | Stremmel | 222/327 |
| 3,231,147 | 1/1966 | Leahy | 222/326 |
| 3,782,598 | 1/1974 | Basa | 222/340 |
| 3,847,304 | 11/1974 | Cohen | 222/326 |
| 4,865,229 | 9/1989 | Schneider et al. | 222/325 |

FOREIGN PATENT DOCUMENTS

| | | | |
|---|---|---|---|
| 1053983 | 11/1963 | United Kingdom | 222/392 |

*Primary Examiner*—H. Grant Skaggs
*Assistant Examiner*—Kenneth Noland
*Attorney, Agent, or Firm*—Goodman & Teitelbaum

[57] ABSTRACT

A dispenser gun having a hollow tubular body member for receiving a cartridge of flowable material therein, and a removable cap member to maintain the cartridge within the body member so that a nozzle of the cartridge extends through an opening in the cap member. The body member includes a trigger mechanism for acting upon a cam retaining mechanism to disengage a cable into a released position to allow a spring biased pressure disc, which is connected to the cable, to act upon the cartridge to dispense or discharge the flowable material therefrom. In the non-discharging position, the cam retaining mechanism engages the cable in a locked position so that the cable prevents any forward movement of the pressure disc against the cartridge. The cartridge can be of either the disposable type or the reusable type, where a liquid impermeable insert bag can be inserted within the reusable type cartridge. A tool can be used to move the pressure disc back to its original position within the body member to receive a new cartridge within the body member.

25 Claims, 3 Drawing Sheets

DISPENSER GUN

BACKGROUND OF THE INVENTION

This invention relates to a dispenser device and, more particularly, to a dispenser gun, such as a caulking gun and the like, having a trigger for releasing a cable to allow a spring to force flowable material such as caulking or other like material, out of the dispensing end of the dispenser gun.

Caulking guns are well known, being usually constructed to receive a commercially available caulking cartridge, whereby the caulking material is dispensed upon pulling of the trigger of the caulking gun. However, due to the viscous composition of the caulking material, an excess amount of pressure has to be exerted in order to squeeze the trigger when operating the caulking gun.

U.S. Pat. No. 4,090,639 discloses a dispenser gun which is operated by squeezing the trigger thereof to tilt a gripping ring in order to advance the ring and a piston rod connected thereto, so that a piston secured on the end of the piston rod discharges a paste material contained in a cartridge of the dispenser gun. Accordingly, the pressure on the trigger must be sufficient in order to advance the piston for the discharge of the paste material.

The above mentioned problem is solved to a degree by a power operated caulking gun disclosed in U.S. Pat. No. 4,024,994, wherein the power required to drive the piston through the gun to force the caulking material therefrom is applied by means of an electric motor.

U.S. Pat. No. 3,782,598 discloses a dispenser device including a hollow container portion for receiving flowable material therein. A plunger is slidingly mounted within the container portion, and a spring normally urges the plunger towards the outlet. A rod is secured to the plunger and is provided with recesses therein which receive a detent member of the trigger means so that when the detent member is engaged in one of the recesses, the plunger is held against movement. When it is desired to discharge the flowable material from the container portion, the trigger is squeezed to withdraw the detent member from the recesses, thereby freeing the rod and the associated plunger for movement under the influence of the spring so that the plunger discharges the flowable material. It is noted, that the rod must have a longitudinal length equal to more than twice the longitudinal length of the container portion.

SUMMARY OF THE INVENTION

It is, accordingly, an object of the present invention to provide a dispenser gun which avoids the problems of the prior art.

Another object of the present invention is to provide a dispenser gun that is simple and practical in construction, which is economical to manufacture, and which is efficient and reliable in use.

A further object of the present invention is to provide a dispenser gun provided with a trigger mechanism which does not require an excessive amount of pressure to be extended in order to squeeze the trigger mechanism when operating the dispenser gun.

Still another object of the present invention is to provide a dispenser gun that is capable of using cartridges of either the disposable type or the reusable type, and which permits a liquid impermeable insert bag to be inserted within the reusable type cartridge.

A further object of the present invention is to provide a dispenser gun as described above, that includes spring means for providing a spring force upon the cartridge to dispense a flowable material therefrom.

Another object of the present invention is to provide a dispenser gun as described above, that includes cable means for controlling the spring force of the spring means acting on the cartridge.

And still a further object of the present invention is to provide a dispenser gun as described above, that includes retaining means for engaging the cable means in a locked position to prevent the spring means from acting upon the cartridge, and also for releasing the cable means so that the spring means acts upon the cartridge.

Another object of the present invention is to provide a dispenser gun as described above, wherein the trigger mechanism moves the retaining means out of engagement with the cable means to release same in order to discharge the flowable material.

Briefly, in accordance with the present invention, there is provided a dispenser gun, such as a caulking gun, that includes a hollow tubular body member for receiving a cartridge of flowable material therein, such as caulking material, and a removable cap member to maintain the cartridge therein so that a nozzle of the cartridge extends through an opening in the cap member. The body member includes release means, such as a trigger mechanism, for acting upon retaining means, such as a cam retaining mechanism, to disengage a cable into a released position to allow spring means including a spring biased pressure disc, which is connected to the cable, to act upon the cartridge to dispense or discharge the flowable material therefrom. In the non-operating condition or non-discharging position, the retaining means engages the cable in a locked position so that the cable prevents any forward movement of the pressure disc against the cartridge. The cartridge can be of either the disposable type or the reusable type, where a liquid impermeable insert bag can be inserted within the reusable type cartridge. Preferably, a tool is used to move the pressure disc rearwardly back to its original position within the body member to receive a new cartridge within the body member.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings, like reference characters designate like parts.

DESCRIPTION OF THE PREFERRED EMBODIMENTS

Figure 1:
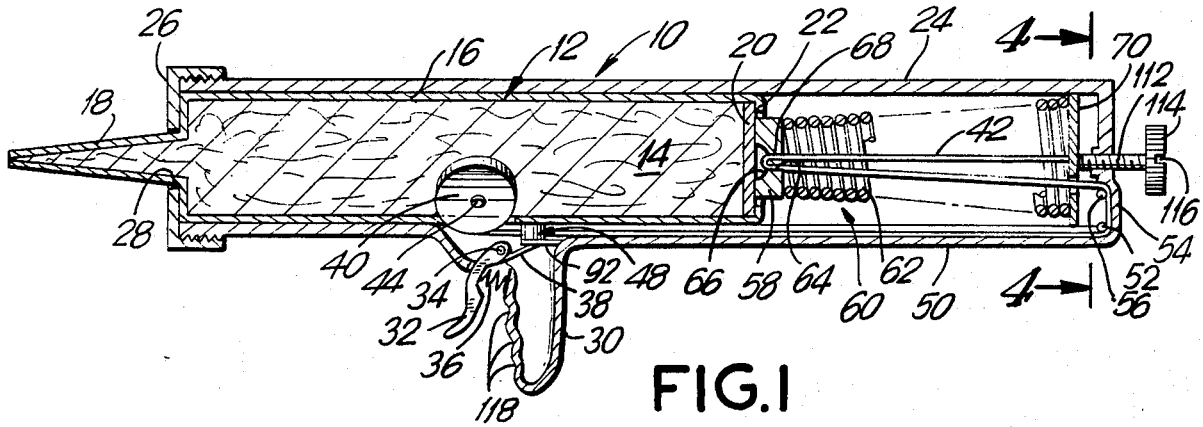
FIG. 1 is a side cross sectional view of a dispenser gun in accordance with the present invention, showing a caulking gun provided with a caulking cartridge filled with caulking material.

Referring now to the drawings, FIG. 1 discloses a dispenser gun in accordance with the present invention, and more particularly, shows the cross section of a caulking gun 10 provided with a conventional caulking cartridge 12 filled with caulking material 14. The caulking cartridge 12 is well known in the art, and includes a tubular casing 16 having a nozzle 18 at the front end thereof, and a movable disc 20 at the rear end thereof. The casing 20 is turned in at the rear end thereof to provide a flange 22 to prevent the disc 20 from being pushed out of the rear end of the casing 16.

The caulking gun 10 includes a hollow tubular body member 24 and a removable cap member 26 which is securely threaded onto the front end of the body member 24. The cap member 26 has an opening 28 centrally therethrough to receive the nozzle 18 of the caulking cartridge 12. The body member 24 is provided with a handle member 30 extending outwardly therefrom which is slightly off center to be closer to the front end of the body member 24. A trigger member 32 is mounted in front of the handle member 30 by a pin 34 so that the trigger member 32 can pivot towards and away from the handle member 30. A spring member 36 is disposed between the trigger member 32 and the handle member 30 to force the trigger member 32 away from the handle member 30 when not being operated, as shown in FIG. 1, to provide a non-discharging position, as will be explained below. A bar member 38 is secured to the inner end of trigger member 32 for pivoting movement therewith, so that the trigger member 32 and the bar member 38 provide a release mechanism as also will be explained below.

Figure 3:
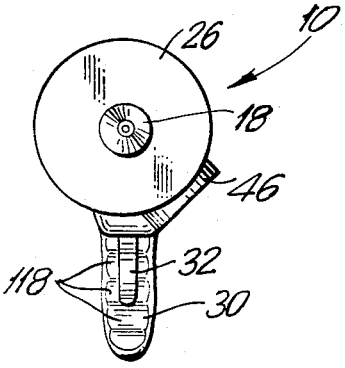
FIG. 3 is a front elevational view of FIG. 1.

A spring loaded spool 40 has a high tension wire or cable 42 extendable therefrom so that the cable 42 can be pulled out of the spool 40 or retracted into the spool 40, as will be explained below in more detail. The spool 40 is mounted by suitable means, such as a pin 44, within a housing portion 46 extending outwardly from the body member 24, as shown in FIG. 3. The spool 40 lies within the housing portion 46 so as to not interfere with the caulking cartridge casing 16, where the spool 40 is disposed adjacent the outside surface of the casing 16. The cable 42 is fabricated from a suitable metal material, or a suitable plastic material, or any other suitable like material.

Figure 4:
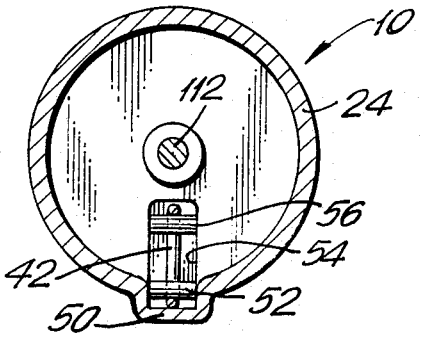
FIG. 4 is a cross sectional view taken along line 4—4 of FIG. 1.

From the spool 40, the cable 42 extends rearwardly through a retaining mechanism 48. The retaining mechanism 48 is adjacent to the trigger member 32 for engagement with the bar member 38, as will be explained below. Preferably, the cable 42 extends within a longitudinally extending recess 50, which is formed in the body member 24, to the rear of the body member 24. From the rear of the recess 50, the cable 42 engages around a bar 52 and extends transversely within a second recess 54, which is formed in the rear wall of the body member 24, to a second bar 56 provided in the recess 54, as shown in FIG. 4. The cable 42 engages around the bar 56 so that the cable 42 now extends in a forward direction towards a pressure block 58 of the spring means 60.

The cable 42 extends through the central opening of the coil spring 62 of the spring means 60, the coil spring 62 being secured to the pressure block 58 by conventional means. The cable 42 then passes through a first hole 64 formed through the pressure block 58, then is looped back within a forward recess 66 formed in the pressure block 58 into a second hole 68 formed through the pressure block 58 so that the cable 42 is connected to the pressure block 58. The cable 42 now extends rearwardly towards the rear wall of the body member 24. The end of the cable 42 is secured by conventional means to a plate 70 disposed between the coil spring 62 and the rear wall of the body member 24 so that the plate 70 engages against the rear end of the coil spring 62.

Figure 2:
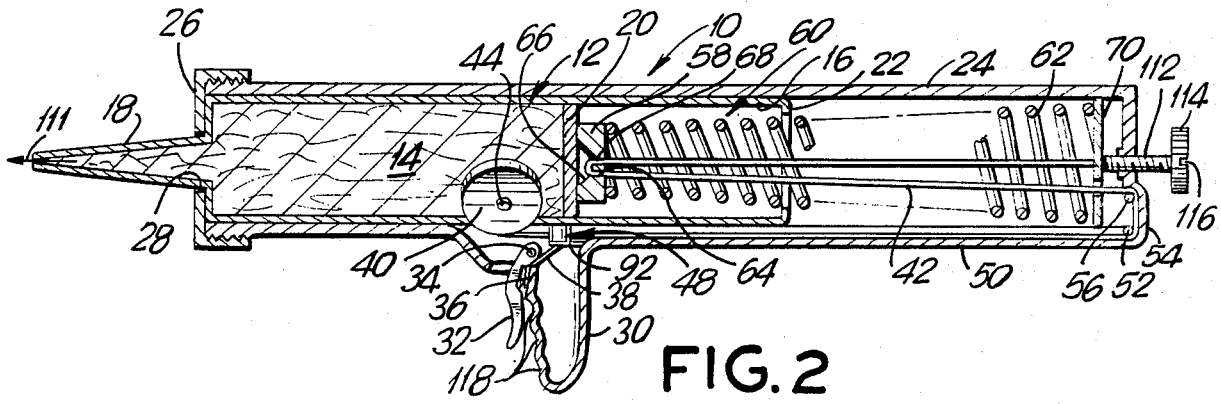
FIG. 2 is a side cross sectional view similar to FIG. 1, showing the caulking material being discharged from the caulking cartridge.
Figure 5:
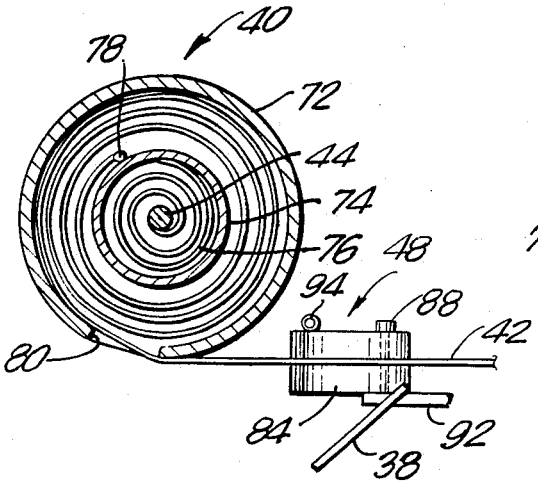
FIG. 5 is a fragmented, partly cross sectional view showing a spring loaded spool of cable and means for retaining the cable in a secured position.

Before discussing FIG. 2 which shows the caulking material 14 being discharged, it is best to discuss the retaining mechanism 48 and the parts related thereto as shown in FIGS. 5–8. Accordingly, FIG. 5 shows the spool 40 and the cable 42 therefrom being positioned through the retaining mechanism 48. The spool 40 includes an outer casing 72 which is fixed stationary relative to the housing portion 46 so that the casing 72 does not move. Within the casing 72 is an inner hollow drum 74 which is free to rotate around the pin 44. Within the drum 74 is a coil spring 76 disposed around the pin 44 with one inner end thereof being secured to the pin 44 and the other outer end thereof being secured to the drum 74 for rotation therewith. The end 78 of the cable 42 is secured to the drum 74 for rotation therewith, and the cable 42 is wrapped around the drum 74 for as many turns as required until exiting out through an opening 80 in the casing 72 from where it passes through the retaining mechanism 48.

Figure 6:
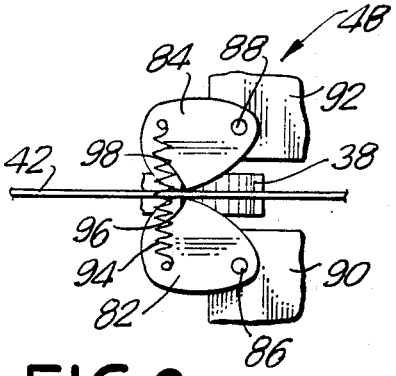
FIG. 6 is a fragmented top view showing the means of FIG. 5 retaining the cable in the secured position.

As shown in FIGS. 5 and 6, the retaining mechanism 48 includes two cam discs 82, 84 which are pivotly mounted by pins 86, 88 on spaced apart support members 90, 92 which are connected to the body member 24 as indicated in FIGS. 1 and 2. A spring 94 has the opposite ends thereof secured to the cam discs 82, 84 to force the outer cam portions 96, 98 of the cam discs 82, 84 towards each other. As shown in FIG. 6, the outer cam portions 96, 98 are in engagement with the cable 42 which is disposed therebetween, so that the cam portions 96, 98 retain the cable 42 to lock the cable 42 in place. It is noted, that any pull on the cable 42 towards the rear of the body member 24 will cause the cam discs 82, 84 to pivot further inwardly towards each other, which would tend to increase the frictional force of the cam discs 82, 84 acting upon the cable 42 to further insure the retention of the cable 42 in a locked position. Therefore, a large spring tension provided from the spring 94 is not required. Preferably, the cam discs 82, 84 are fabricated from a rubber-like material to provide a sufficient frictional force when acting upon the cable 42.

It is noted, that the bar member 38 of the release mechanism is positioned at an angle to the cam discs 82, 84, as shown in FIG. 5, with the free end of the bar member 38 being positioned between the rear portions of the cam discs 82, 84 as shown in FIG. 6. With an understanding of the above, the functioning of the caulking gun 10 will now be described.

In FIG. 1, the spool 40, the cable 42, the retaining mechanism 48 and the bar member 38 are positioned as shown in FIGS. 5 and 6. When the trigger member 32 is squeezed by the user's finger towards the handle member 30, as shown in FIG. 2, the bar member 38 is pivoted forwardly together with the trigger member 32 in the direction of the arrow 100 shown in FIG. 7. Accordingly, the bar member 38 moves forwardly in the direction of the arrow 102, shown in FIG. 8, between the cam discs 82, 84, and engages the edges of the cam discs 82, 84 to pivot the cam discs 82, 84 outwardly away from each other in the direction of the arrows 104, 106 against the tension of the spring 94. As mentioned above, the spring tension of the spring 94 is not large, so that a large amount of pressure is not required when squeezing the trigger member 32 in order to move the cam discs 82, 84 apart.

Figure 7:
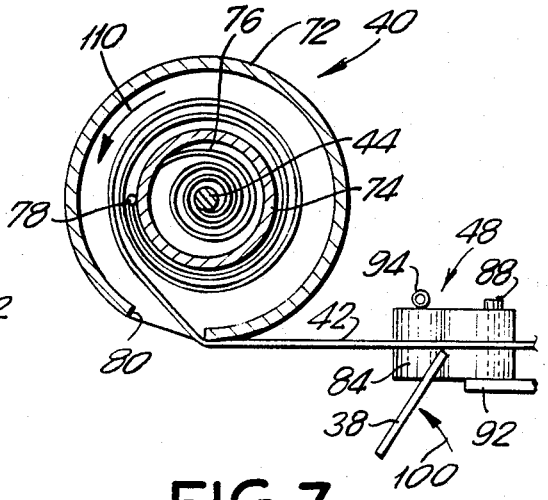
FIG. 7 is a fragmented, partly cross section view similar to FIG. 5, showing the retaining means in a released position.
Figure 8:
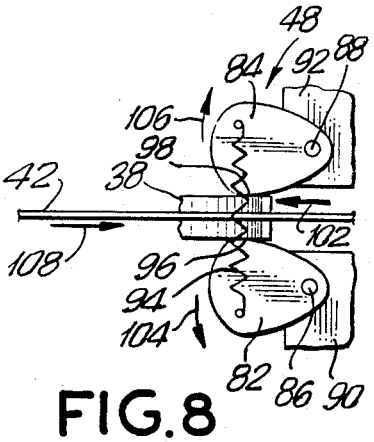
FIG. 8 is a fragmented top view showing the retaining means of FIG. 7 in the released position.

It is noted, that when the cable 42 is in the locked position, as shown in FIGS. 1, 5 and 6, the pressure block 58 of the spring means 60 is prevented by the cable 42 from being moved forwardly by the force exerted by the coil spring 62, where the force of the coil spring 62 only tends to further pivot the cam discs 82, 84 towards each other, as set forth above. Accordingly, when the cam discs 82, 84 are pivoted apart from each other, as shown in FIG. 8, the cable 42 is disengaged into a released position, causing the coil spring 62 to push the pressure block 58 forward, thereby pulling the cable 42 in the direction of the arrow 108, shown in FIG. 8, out of the spool 40. When the cable 42 is being pulled from the spool 40 in the direction of the arrow 110, as shown in FIG. 7, the drum 74 of the spool 40 is also caused to rotate in the same direction, so that the coil spring 76 within the drum 74 is wound up, where the force of the coil spring 62 is greater than the force of the coil spring 76. The function of the coil spring 76 will be discussed below.

As long as the trigger member 32 is being squeezed, as shown in FIG. 2, the cable 42 is in the released position, and the coil spring 62 continues to push the pressure block 58 forward into the casing 16 of the caulking cartridge 12, so that the pressure block 58 in turn pushes the disc 20 of the caulking cartridge 12 forward therein to dispense the caulking material 14 out of the caulking cartridge casing 16 through the nozzle 18 in the direction of arrow 111. Accordingly, when the trigger member 32 is released, the spring 36 pushes the trigger member 32 away from the handle member 30 to pivot the bar member 38 back to its original position shown in FIGS. 5 and 6. The spring 94 can now pivot the cam discs 82, 84 towards each other so that the cable 42 is again in the locked position between the cam discs 82, 84, thereby preventing any further forward motion of the pressure block 58, and thus stopping the dispensing of the caulking material 14 from the nozzle 18 of the caulking cartridge 12. This above procedure continues until the caulking cartridge 12 is empty.

In order to ensure that all the caulking material 14 is emptied out of the caulking cartridge 12, a screw 112 is threadingly engaged through the rear end of the body member 24 of the caulking gun 10, and bears against the rear surface of the plate 70 which engages the coil spring 62, as set forth above. Accordingly, rotating the screw 112 will move the plate 70 either forwardly or rearwardly depending upon the direction of rotation of the screw 112, so that the plate 70 pushes against or releases the pressure on the coil spring 62 in order to control the spring pressure thereof. For example, when there is a small amount of caulking material 14 still in the caulking cartridge 12, but no caulking material 14 is being dispensed from the nozzle 18, by turning the screw 112 so that the plate 70 is moved forwardly, the coil spring 62 will exert a further pressure on the pressure block 58, which is within the casing 16, to force the disc 20 of the caulking cartridge 12 further forward to dispense the remaining caulking material 14 from the caulking cartridge 12. It is further noted, that the screw 112 can be used to adjust the position of the pressure block 58 within the body member 24 to allow the body member 24 to receive therein different sized caulking cartridges, which vary slightly in length, so that the pressure block 58 is always positioned against the rear disc 20 of the inserted filled caulking cartridge 12, as shown in FIG. 1.

The screw 112 has an enlarged head 114 provided with knurls on the outer edge thereof so that the screw 112 can be turned by the user's fingers. Additionally, a slot 116 is provided across the rear surface of the screw 112 to receive a tool therein, such as a screwdriver, for rotation of the screw 112 in the case where a larger force is required to turn the screw 112.

Accordingly, when all the caulking material 14 has been dispensed from the caulking cartridge 12, the cap member 26 is unscrewed and removed from the body member 24. The caulking cartridge 12 is then removed from the caulking gun 10 and is disposed of. A sufficiently long rod or tool, not shown, is then inserted into the opening of the body member 24 to be positioned against the pressure block 58, and then is pushed further into the body member 24 to move the pressure block 58 rearwardly back to its original position shown in FIG. 1. A new filled caulking cartridge can now be inserted into the body member 24.

It is noted, that as the pressure block 58 is being moved rearwardly, the pressure on the cable 42 caused by the spring means 60 is removed, so that the coil spring 76 of the spool 40 will unwind from the wound position shown in FIG. 7, and cause the drum 74 to rotate clockwise to retract the cable 42 and wind the cable 42 around the drum 74 to the position shown in FIG. 5.

It is further noted, that due to the fact the cable 42, as shown in FIG. 6, is now being moved to the left, the cam discs 82, 84 will easily be pivoted slightly away from each other by the cable 42 and will not prevent the cable 42 from being wound up on the drum 74, where the spring force of the coil spring 76 is greater than the spring force of the spring 94 which normally acts to pivot the cam discs 82, 84 together.

Accordingly, when the tool for pushing the pressure block 58 is removed, the spring means 60 will again act upon the cable 42 so that the cable 42 shown in FIG. 6 would tend to move to the right, but will be prevented from any movement to the right by the cam discs 82, 84 in the same manner mentioned above, so that the pressure block 58 will be held by the cable 42 in a stationary position to allow for the insertion of a new caulking cartridge.

As shown in FIGS. 1 and 2, the cable 42 is looped through the pressure block 58 for connection thereto, and to also provide two lines of cable from the pressure block 58 to thereby reduce the force on the cable 42 by one-half Obviously, if desired, the end of the cable 42 can be connected directly to the pressure block 58 without extending rearwardly to the plate 70, where in this latter case, the cable 42 would have to be strengthened to support the increased double force thereon.

Additionally, as shown in FIGS. 1–3, the handle member 30 is preferably provided with finger grip portions 118 in the front edge thereof, as best shown in FIG. 30, to receive the fingers of the user. Additionally, the trigger member 32 is also arcuately shaped to comfortably receive the trigger finger of the user.

Figure 9:
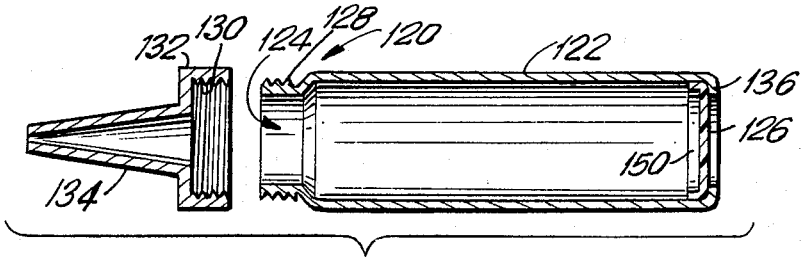
FIG. 9 is an exploded side cross sectional view of a modified dispenser cartridge in accordance with the present invention.

Instead of using the disposable type of caulking cartridge 12 as previously described, FIG. 9 shows a reusable cartridge 120 which can be used with the dispenser or caulking gun 10 of the present invention. The cartridge 120 can be used to dispense or discharge various flowable materials, including liquids, rather than just dispensing the caulking material 14, and can even be used for dispensing relatively viscous or slow-flowing materials.

The cartridge 120 includes a tubular casing 122 having an opening 124 at the front end thereof, and a movable disc 126 at the rear end thereof. The wall around the opening 124 is reduced and is provided with an external thread 128 to threadingly receive the internal thread 130 of the cap 132 thereon, where the outside diameter of the cap 132 is the same of the outside diameter of the casing 122. The cap 132 is provided with an outwardly extending nozzle 134 centrally located at the front end thereof. The casing 122 is turned in at the rear end thereof to provide a flange 136 to prevent the disc 126 from being pushed out at the rear end of the casing 122. The function of the disc 126 will be discussed below.

Figure 10:
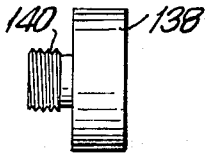
FIG. 10 is a side view showing a modification of the cap member shown in FIG. 9.
Figure 11:
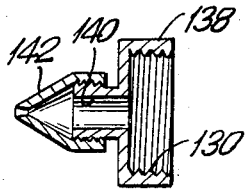
FIG. 11 is a side cross sectional view showing the modified cap member of FIG. 10 provided with a short nozzle.
Figure 12:
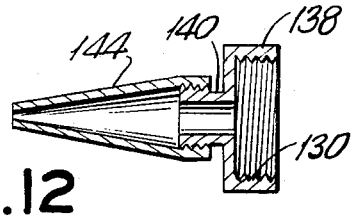
FIG. 12 is a side cross sectional view showing the modified cap member of FIG. 10 provided with a long nozzle.

FIGS. 10, 11 and 12 disclose a modification of the cap 132 shown in FIG. 9. FIG. 10 shows a modified cap portion 138 with the nozzle thereof removed. In place of the nozzle, the cap portion 138 is provided with an externally threaded boss 140. FIG. 11 shows the internal threads 130 of the cap portion 138, and a longitudinally extending short nozzle 142 threadingly engaged on the boss 140. It is noted, that the rear end of the nozzle 142 is spaced from the cap portion 138 to provide a space for the above-mentioned opening 28 of the cap member 26 of the caulking gun 10.

FIG. 12 shows a longitudinally extending long nozzle 144 threadingly engaged on the boss 140 with the rear end thereof also being spaced from the cap portion 138 for the above-mentioned reason. Accordingly, this modification permits the user to select a particular type of nozzle, either short or long, for dispensing the flowable material, where obviously additional nozzles can be provided having different longitudinal lengths as desired, depending upon the type of flowable material being dispensed or discharged.

Figure 13:
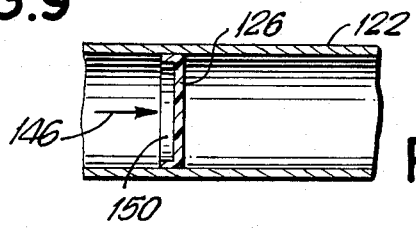
FIG. 13 is a fragmented, cross sectional view showing the rear plate member of FIG. 9 being moved rearwardly.
Figure 14:
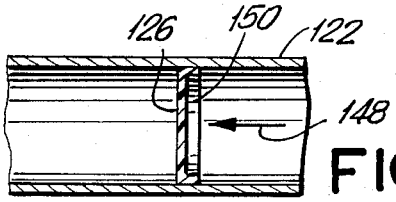
FIG. 14 is a fragmented, cross sectional view showing the rear plate member of FIG. 9 being moved forwardly.

FIG. 13 shows the disc 126 being moved rearwardly in the direction of the arrow 146 within the casing 122 in order to refill the casing with the flowable material. FIG. 14 shows the disc 126 being moved forwardly in the direction of the arrow 148 within the casing 122 when the flowable material is being dispensed. Accordingly, the disc 126 is fabricated from a plastic-like or rubber-like material so that the ends of the disc 126 are flexible to form a rim 150. As shown in FIG. 13, when moved rearwardly in the direction of the arrow 146, the rim 150 is disposed on the forward side of the disc 126. As shown in FIG. 14, when being moved forwardly in the direction of the arrow 148, the rim 150 is on the rear side of the disc 126. The function of the rim 150 is to form a liquid-tight seal with the interior walls of the casing 126 to prevent any leakage of the flowable material, including liquids, from the casing 122, where the rim 150 is always in sealing contact with the interior wall of the casing 122.

Figure 15:
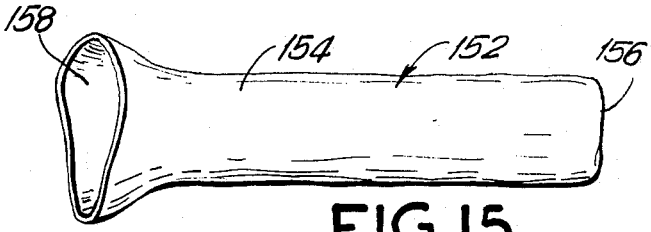
FIG. 15 is a perspective view of an insert bag in accordance with the present invention.

FIG. 15 shows a liquid impermeable insert bag 152 fabricated from a plastic-like material. The insert bag 152 has a body portion 154 which is longer than the casing 122, a closed rear end 156, and an opening 158 at the forward end. Accordingly, the insert bag 152 receives the flowable material therein, the insert bag 152 being best used for liquids.

Figure 16:
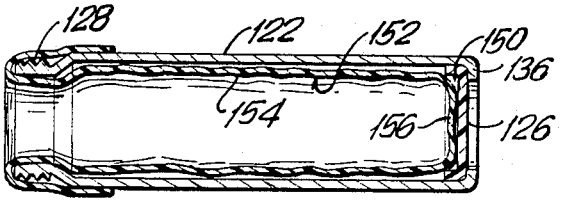
FIG. 16 is a cross sectional view showing the insert bag of FIG. 15 disposed in the casing of the dispenser cartridge of FIG. 9.

As shown in FIG. 16, the insert bag 152 is inserted into the casing 122 with the mouth of the forward end, which has the opening 158, being folded back over the outer surface of the front end of the casing 122. After the insert bag 152 is filled with the forwardable material, the above-mentioned cap 132 or cap portion 138 is threaded onto the thread 128 of the casing 122 with the forward end of the insert bag 152 being secured therebetween. Thus, the insert bag 152 further ensures that there is no leakage of the flowable material within the casing 122, and also permits the flowable material to be prestored in several insert bags 152 for continuous insertion, one after the other, within the casing 122 after each insert bag 152 is emptied.

Figure 17:
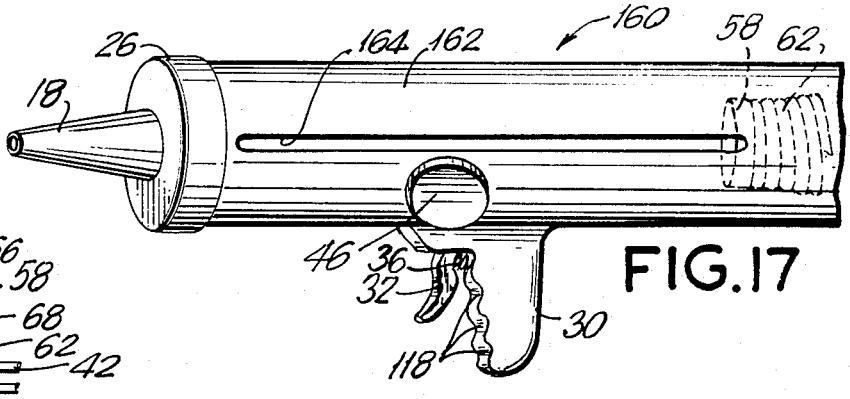
FIG. 17 is a fragmented perspective view of a modified dispenser gun in accordance with the present invention.
Figure 18:
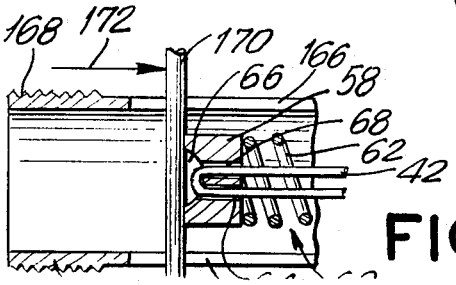
FIG. 18 is a fragmented, partly cross sectional view showing the dispensing spring means of the modified dispenser gun of FIG. 17 being moved rearwardly.

FIG. 17 shows a modified dispenser gun 160 which is the same as the above mentioned caulking gun 10, except the hollow tubular body member 162 thereof is provided with longitudinally extending slots 164, 166 on opposite sides thereof, as shown in FIG. 18. Accordingly, the slots 164, 166 provide an alternative method to the procedure mentioned above for returning the pressure block 58 to its original position, shown in FIG. 1, after the empty caulking cartridge 12 or cartridge 120 has been removed. The slots 164, 166 extend forwardly as close to the forward end as possible without interfering with the thread 168 thereon, and extend rearwardly to the most rear position possible for the pressure block 58, as indicated in FIG. 1.

Accordingly, after the cap member 26 is removed and the empty caulking cartridge 12 or cartridge 120 is taken out of the dispenser gun 160, a tool 170 is inserted through the forward most portions of the slots 164, 166.

The tool 170 is then pushed rearwardly within the slots 164, 166 in the direction of the arrow 172 until the tool 170 reaches the rear most portions of the slots 164, 166. The tool 170 is now removed from the slots 164, 166, where the pressure block 58 is now in its original position shown in FIG. 1 so that a new filled caulking cartridge 12 or cartridge 120 can be inserted into the body member 162. It is noted, that during the above procedure, the cable 42 is being wound around the drum 74 of the spool 40 in the same manner as mentioned above, and that after the tool 170 is removed, the pressure block 58 will be held by the cable 42 in a stationary locked position in the same manner as mentioned above to allow the insertion of the new cartridge.

Numerous changes in the structures hereinabove described may suggest themselves to those skilled in the art, however, it is understood that the present disclosure relates to preferred embodiments of the invention, and is not to be construed as a limitation of the invention.

What is claimed is:

1. A dispenser gun for flowable materials comprising:

a hollow tubular body member for receiving a cartridge of flowable material therein;

a removable cap member disposed on a front end of said body member to hold the cartridge within said body member with a nozzle of the cartridge extending outwardly through an opening in said cap member;

spring means disposed within a rear portion of said body member for providing a spring force upon the cartridge to dispense the flowable material from the cartridge through the nozzle;

cable means being connected to said spring means for controlling said spring force of said spring means on the cartridge;

retaining means for engaging said cable means in a locked position so that said cable means prevents said spring means from providing said spring force on the cartridge, and for releasing said cable means into a released position so that said cable means permits said spring means to provide said spring force upon the cartridge;

release means for moving said retaining means out of engagement with said cable means so that said cable means is in said released position, and for permitting said retaining means to move into engagement with said cable means so that said cable means is in said locked position;

said cable means including a cable extending at least from said retaining means to said spring means;

said spring means including a coil spring and a pressure block secured to a forward end of said coil spring for acting upon the cartridge, said cable being connected to said pressure block; and said cable extending forwardly through a first hole in said pressure block, and being looped rearwardly back through a second hole in said pressure block so that a rear end of said cable extends towards a rear wall of said body member;

whereby the flowable material is only dispensed from the cartridge when said cable means is in said released position.

2. A dispenser gun according to claim 1, wherein one end of said cable is secured within a spring loaded spool, so that a portion of said cable can be pulled out of said spool and also retracted into said spool, said spool being positioned adjacent to said retaining means.

3. A dispenser gun according to claim 1, wherein said rear end of said cable is secured to a plate disposed between said coil spring and said rear wall of said body member, said plate being engaged against a rear end of said coil spring.

4. A dispenser gun according to claim 3, wherein said rear wall of said body member includes a screw means for engaging a rear surface of said plate to adjust said spring force of said spring means.

5. A dispenser gun according to claim 1, wherein one end of said cable is secured within a spring loaded spool so that a portion of said cable can be pulled out of said spool and also retracted into said spool, said spool being positioned adjacent to said retaining means.

6. A dispenser gun according to claim 1, wherein said retaining means includes a pair of cam discs and pivot means to pivot said cam discs towards and away from each other, said cable being disposed between said cam discs so that when said cam discs are pivoted toward each other, said cam discs engage said cable to lock said cable in place to prevent any movement of said cable.

7. A dispenser gun according to claim 1, wherein said release means includes a spring biased trigger member and a bar member connected to said trigger member, pin means for pivoting said trigger member and said bar member together, said bar member being positioned adjacent to said retaining means so that when said trigger member is squeezed, said bar member is pivoted into engagement with said retaining means to move said retaining means out of engagement with said cable means.

8. A dispenser gun according to claim 1, including a reusable cartridge provided with a removable cartridge cap.

9. A dispenser gun according to claim 8, wherein said cartridge cap is provided with a removable nozzle.

10. A dispenser gun according to claim 8, wherein said cartridge cap is provided with a set of removable nozzles ranging from a longitudinally short nozzle to a longitudinally long nozzle.

11. A dispenser gun according to claim 8, wherein said reusable cartridge is provided with a movable disc therein, said movable disc being fabricated from a flexible material to provide a liquid-tight sealing rim for engaging interior walls of said reusable cartridge to prevent any leakage of the flowable material from said reusable cartridge.

12. A dispenser gun according to claim 8, wherein said reusable cartridge is provided with a liquid impermeable insert bag disposed therein.

13. A dispenser gun according to claim 11, wherein said body member is provided with repositioning means for returning said spring means to a rearmost position in said body member.

14. A dispenser gun according to claim 13, wherein said repositioning means includes longitudinally extending slots provided in opposite sides of said body member for receiving a tool therethrough for moving said spring means rearwardly.

15. A dispenser gun for flowable materials comprising:

a hollow tubular body member for receiving a cartridge of flowable material therein;

a removable cap member disposed on a front end of said body member to hold the cartridge within said body member with a nozzle of the cartridge extending outwardly through an opening in said cap member;

spring means disposed within a rear portion of said body member for providing a spring force upon the cartridge to dispense the flowable material from the cartridge through the nozzle;

cable means being connected to said spring means for controlling said spring force of said spring means on the cartridge;

retaining means for engaging said cable means in a locked position so that said cable means prevents said spring means from providing said spring force on the cartridge, and for releasing said cable means into a released position so that said cable means permits said spring means to provide said spring force upon the cartridge;

release means for moving said retaining means out of engagement with said cable means so that said cable means is in said released position, and for permitting said retaining means to move into engagement with said cable means so that said cable means is in said locked position;

said cable means including a cable extending at least from said retaining means to said spring means; and said retaining means including a pair of cam discs and pivot means to pivot said cam discs towards and away from each other, said cable being disposed between said cam discs so that when said cam discs are pivoted toward each other, said cam discs engage said cable to lock said cable in place to prevent any movement of said cable;

whereby the flowable material is only dispensed from the cartridge when said cable means is in said released position.

16. A dispenser gun according to claim 15, wherein said cam discs are provided with spring means to pivotally move said can discs toward each other.

17. A dispenser gun according to claim 15, wherein said release means includes a spring biased trigger member and a bar member connected to said trigger member, pin means for pivoting said trigger member and said bar member together, said bar member being positioned between said cam discs so that when said trigger member is squeezed, said bar member is pivoted into engagement with said cam discs to pivotally move said cam discs away from each other to release said cable.

18. A dispenser gun according to claim 15, wherein one end of said cable is secured within a spring loaded spool, so that a portion of said cable can be pulled out of said spool and also retracted into said spool, said spool being positioned adjacent to said retaining means.

19. A dispenser gun according to claim 15, including a reusable cartridge provided with a removable cartridge cap.

20. A dispenser gun according to claim 19, wherein said cartridge cap is provided with a removable nozzle.

21. A dispenser gun according to claim 19, wherein said cartridge cap is provided with a set of removable nozzles ranging from a longitudinally short nozzle to a longitudinally long nozzle.

22. A dispenser gun according to claim 19, wherein said reusable cartridge is provided with a movable disc therein, said movable disc being fabricated from a flexible material to provide a liquid-tight sealing rim for engaging interior walls of said reusable cartridge to prevent any leakage of the flowable material from said reusable cartridge.

23. A dispenser gun according to claim 19, wherein said reusable cartridge is provided with a liquid impermeable insert bag disposed therein.

24. A dispenser gun according to claim 15, wherein said body member is provided with repositioning means for returning said spring means to a rearmost position in said body member.

25. A dispenser gun according to claim 24, wherein said repositioning means includes longitudinally extending slots provided in opposite sides of said body member for receiving a tool therethrough for moving said spring means rearwardly.

* * * * *